US011294304B2

(12) United States Patent
Katsumata

(10) Patent No.: US 11,294,304 B2
(45) Date of Patent: Apr. 5, 2022

(54) IMAGE FORMING APPARATUS AND CONTROL METHOD

(71) Applicant: TOSHIBA TEC KABUSHIKI KAISHA, Tokyo (JP)

(72) Inventor: Isamu Katsumata, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/988,783

(22) Filed: Aug. 10, 2020

(65) Prior Publication Data

US 2021/0255564 A1 Aug. 19, 2021

(30) Foreign Application Priority Data

Feb. 14, 2020 (JP) ..... JP2020-023348

(51) Int. Cl.
*G03G 15/08* (2006.01)
*G03G 15/00* (2006.01)

(52) U.S. Cl.
CPC ..... *G03G 15/0877* (2013.01); *G03G 15/0856* (2013.01); *G03G 15/0865* (2013.01); *G03G 15/50* (2013.01); *G03G 15/556* (2013.01)

(58) Field of Classification Search
CPC ..... G03G 15/0856; G03G 15/0865; G03G 15/0877; G03G 15/50; G03G 15/556
See application file for complete search history.

(56) References Cited

U.S. PATENT DOCUMENTS 5,937,225 A * 8/1999 Samuels ..... G03G 15/5025 399/27
6,011,937 A * 1/2000 Chaussade ..... B41J 2/17513 399/24
2003/0138259 A1* 7/2003 Watanabe ..... G03G 15/0822 399/30
2004/0179866 A1* 9/2004 Muramatsu ..... G03G 15/0877 399/258
2006/0127105 A1* 6/2006 Lee ..... G03G 15/556 399/12
2006/0177241 A1* 8/2006 Sato ..... G03G 15/0893 399/254

(Continued)

FOREIGN PATENT DOCUMENTS

JP 2010-078966 4/2010

*Primary Examiner* — David J Bolduc
(74) *Attorney, Agent, or Firm* — Amin, Turocy & Watson LLP

(57) ABSTRACT

According to an embodiment, an image forming apparatus includes an image bearing body, a developing unit, a supplying unit, a detecting unit, and a control unit. The supplying unit supplies a recording agent from a recording agent cartridge to the developing unit. The detecting unit detects a residual amount of the recording agent. The control unit controls, if the recording agent cartridge is not replaced, the supplying unit to supply the recording agent to the developing unit if the detected residual amount decreases to a first residual amount or less and controls, if the recording agent cartridge is replaced, the supplying unit to supply the recording agent in the recording agent cartridge after the replacement to the developing unit if the detected residual amount of the recording agent in the recording agent cartridge before the replacement decreases to a second residual amount or less.

17 Claims, 6 Drawing Sheets

(56) References Cited

U.S. PATENT DOCUMENTS

2006/0280513 A1* 12/2006 Hatakeyama ..... G03G 15/0856 399/27
2007/0071459 A1* 3/2007 Nakazato ..... G03G 15/553 399/12
2007/0071502 A1* 3/2007 Shimizu ..... G03G 15/0872 399/258
2008/0124095 A1* 5/2008 Wakide ..... G03G 15/0863 399/12
2008/0187357 A1* 8/2008 Miura ..... G03G 15/0879 399/120
2009/0110417 A1* 4/2009 Homma ..... G03G 15/0849 399/44
2010/0046966 A1* 2/2010 Ito ..... G03G 15/0856 399/27
2010/0254720 A1* 10/2010 Ajima ..... G03G 15/0266 399/12
2011/0229157 A1* 9/2011 Kawai ..... G03G 15/5079 399/27
2012/0294632 A1* 11/2012 Nishikawa ..... G03G 15/0879 399/27
2013/0148991 A1* 6/2013 Sakata ..... G03G 13/22 399/48
2013/0279934 A1* 10/2013 Hasegawa ..... G03G 15/161 399/71
2013/0308969 A1* 11/2013 Hasegawa ..... G03G 15/0266 399/50
2014/0044442 A1* 2/2014 Taniguchi ..... G03G 15/0872 399/27
2014/0178087 A1* 6/2014 Suzuki ..... G03G 15/011 399/50
2014/0270854 A1* 9/2014 Asai ..... G03G 15/0877 399/258
2015/0104200 A1* 4/2015 Matsumoto ..... G03G 15/556 399/12
2015/0339559 A1* 11/2015 Sayama ..... G03G 15/556 358/1.15
2016/0202627 A1* 7/2016 Kidaka ..... G03G 15/0266 399/50
2016/0378019 A1* 12/2016 Asaka ..... G03G 15/0856 399/27
2016/0378020 A1* 12/2016 Asaka ..... G03G 15/0863 399/27
2016/0378021 A1* 12/2016 Yamane ..... G03G 15/0872 399/262
2017/0060017 A1* 3/2017 Hirota ..... G03G 15/0266
2017/0075277 A1* 3/2017 Kanakubo ..... G03G 21/1892
2018/0004124 A1* 1/2018 Shibukawa ..... G03G 15/0865
2019/0227454 A1* 7/2019 Kawasaki ..... G03G 15/0266
2019/0377281 A1* 12/2019 Itou ..... G03G 15/0863

* cited by examiner

| | |
|---|---|
| A1 | SERIAL NUMBER |
| A2 | ELECTRIFYING BIAS |
| A3 | DEVELOPING BIAS |

| VOLTAGE E [V] | E<4 | 4≦E<4.2 | 4.2≦E<4.4 | 4.4≦E<4.6 | 4.6≦E<4.8 | 4.8≦E |
|---|---|---|---|---|---|---|
| RESIDUAL AMOUNT [g] | MORE THAN 3.5 | 3.5 | 3.4 | 3.3 | 3.2 | 3.1 OR LESS |

| | FIRST RESIDUAL AMOUNT | SECOND RESIDUAL AMOUNT | | |
|---|---|---|---|---|
| RESIDUAL AMOUNT [g] | 3.5 | 3.4 | 3.3 | 3.2 |

IMAGE FORMING APPARATUS AND CONTROL METHOD

CROSS-REFERENCE TO RELATED APPLICATION

This application is based upon and claims the benefit of priority from Japanese Patent Application No. 2020-023348, filed Feb. 14, 2020, the entire contents of which are incorporated herein by reference.

FIELD

Embodiments described herein relate generally to an image forming apparatus and a control method.

BACKGROUND

There is an image forming apparatus that supplies toner from a toner cartridge attached to the image forming apparatus. The supplied toner is stored in a developing unit of the image forming apparatus. The image forming apparatus acquires, from the toner cartridge, control information used in image formation. The control information is decided for each toner of the toner cartridge.

In the image forming apparatus in the past, at timing when the toner cartridge is replaced, the control information used in the image forming apparatus is switched to control information after the replacement. If a residual amount of the toner stored in the developing unit decreases to a predetermined amount or less, the toner is supplied from the toner cartridge after the replacement. In this case, the toner before the replacement and the toner after the replacement are mixed in the developing unit.

Image quality is sometimes deteriorated because of a difference between the control information of the toner before the replacement and the control information of the toner after the replacement, a mixing state of the toners, and the like.

DETAILED DESCRIPTION

An aspect of embodiments is to provide an image forming apparatus and a control method capable of suppressing deterioration in image quality.

In general, according to an embodiment, an image forming apparatus includes an image bearing body, a developing unit, a supplying unit, a detecting unit, and a control unit. An electrostatic latent image is formed on the image bearing body. The developing unit develops, with a recording agent, the electrostatic latent image formed on the image bearing body. The supplying unit supplies the recording agent from a recording agent cartridge to the developing unit. The detecting unit detects a residual amount of the recording agent in the developing unit. The control unit controls, if the recording agent cartridge is not replaced, the supplying unit to supply the recording agent to the developing unit if the residual amount detected by the detecting unit decreases to a first residual amount or less and controls, if the recording agent cartridge is replaced, the supplying unit to supply the recording agent in the recording agent cartridge after the replacement to the developing unit if the residual amount of the recording agent in the recording agent cartridge before the replacement detected by the detecting unit decreases to a second residual amount or less, the second residual amount being less than the first residual amount.

An image forming apparatus and a control method in an embodiment are explained below with reference to the drawings.

Figure 1:
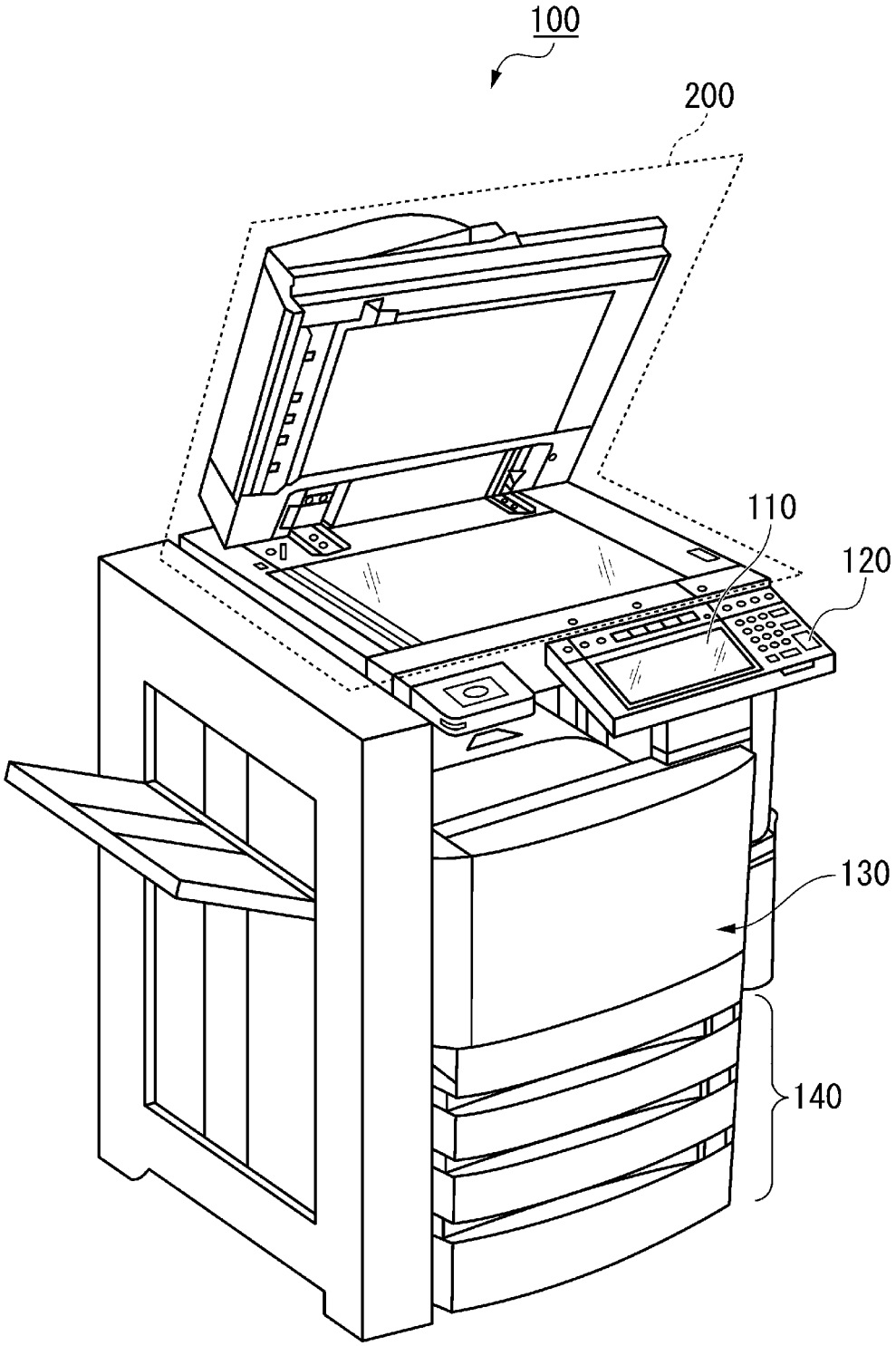
FIG. 1 is an exterior view illustrating an overall configuration example of an image forming apparatus in an embodiment.
Figure 2:
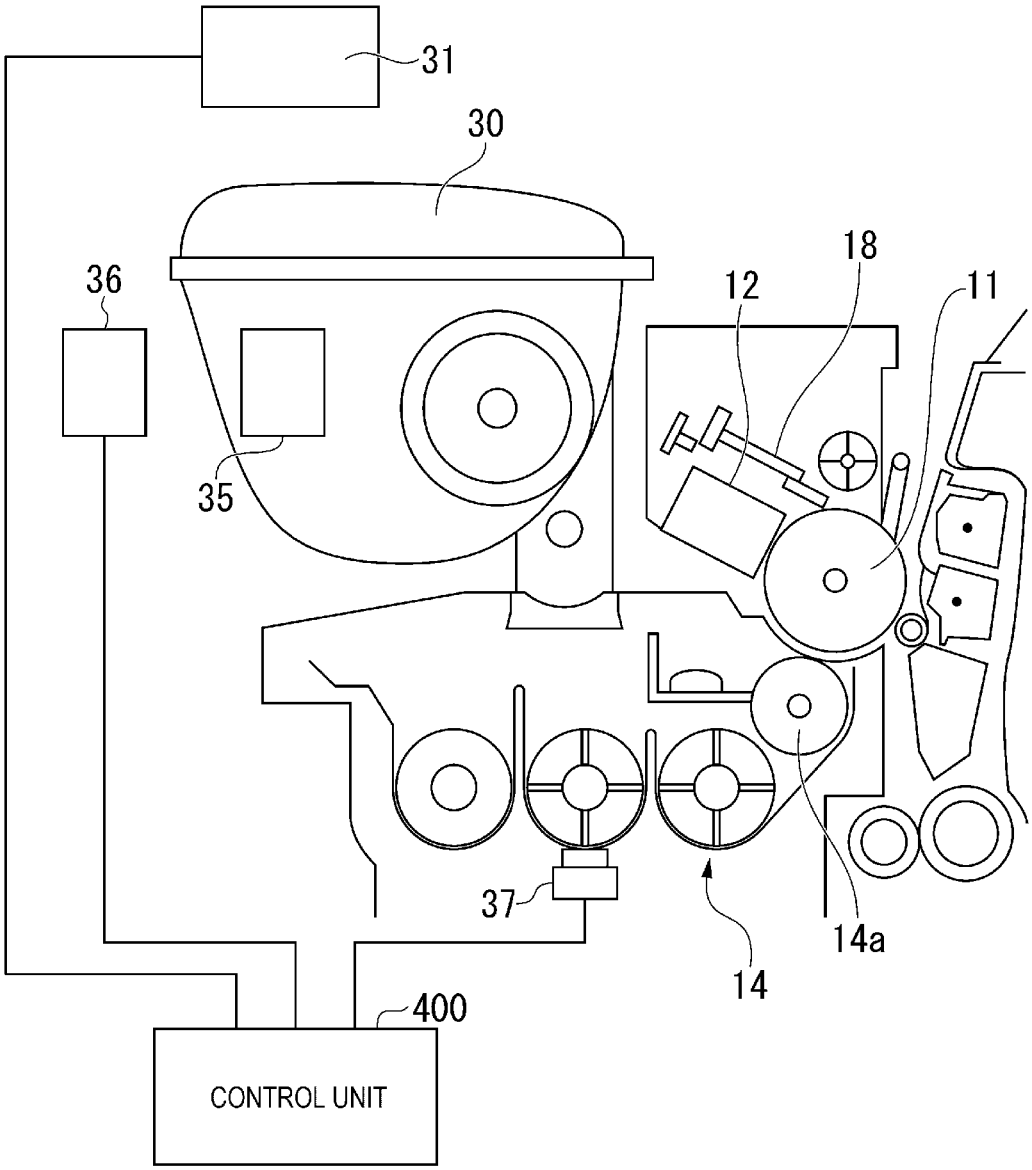
FIG. 2 is a block diagram illustrating a configuration related to toner.

FIG. 1 is an exterior view illustrating an overall configuration example of an image forming apparatus 100 in the embodiment. The image forming apparatus 100 is, for example, an MFP (Multifunction Peripheral). The image forming apparatus 100 includes a display 110, a control panel 120, a print unit 130, a sheet storing unit 140, and a scan unit 200. The image forming apparatus 100 includes a control unit 400 that controls the entire apparatus as illustrated in FIG. 2. The image forming apparatus 100 forms an image on a sheet using a recording agent. The recording agent is, for example, toner. In the following explanation, the recording agent is explained as the toner. The sheet is, for example, paper or label paper. The sheet may be any object if the image forming apparatus 100 can form an image on the surface of the object.

The display 110 is an image display device such as a liquid crystal display or an organic EL (Electro Luminescence) display. The display 110 displays various kinds of information concerning the image forming apparatus 100.

The control panel 120 includes a plurality of buttons. The control panel 120 receives operation by a user. The control panel 120 outputs a signal corresponding to operation performed by the user to the control unit 400 of the image forming apparatus 100. The display 110 and the control panel 120 may be configured as an integral touch panel.

The print unit 130 prints an image on a sheet based on image information generated by the scan unit 200 or image information received via a network. The print unit 130 prints the image using toner. The sheet on which the image is printed may be a sheet stored in the sheet storing unit 140 or may be a manually fed sheet.

The sheet storing unit 140 stores sheets used for image formation in the print unit 130.

The scan unit 200 reads reading target image information as brightness and darkness of light. The scan unit 200 records the read image information. The recorded image information may be transmitted to other information processing devices via a network. The recorded image information may be formed on a sheet as an image by the print unit 130.

FIG. 2 is a block diagram illustrating a configuration of the image forming apparatus 100 related to toner.

In FIG. 2, the control unit 400, a toner cartridge 30, a toner supply motor 31, a storage medium 35, a reading and writing unit 36, and a toner residual amount detection sensor 37 are illustrated. In FIG. 2, a photoconductive drum 11, an electrifying charger 12, a developing device 14, a developing drum 14*a*, and a cleaner 18 are illustrated.

The photoconductive drum 11 is an example of an image bearing body. The photoconductive drum 11 includes an organic photoconductor (OPC) on a supporting member surface. The electrifying charger 12 is an example of an application-to-image-bearing-body unit that applies a voltage to the surface of the image bearing body. Specifically, the electrifying charger 12 sequentially uniformly charges the photoconductive drum 11 according to rotation of the photoconductive drum 11. The cleaner 18 removes residual toner on the photoconductive drum 11. The developing device 14 develops, with toner, an electrostatic latent image formed on the photoconductive drum 11 using the developing drum 14*a*. The developing drum 14*a* is an example of an application-to-recording-agent unit that applies a voltage to toner.

As illustrated in an upper part of FIG. 2, the toner cartridge 30 is provided above the developing device 14. A supply mechanism (a supply auger) in the toner cartridge 30 is driven by rotation of the toner supply motor 31. A developer including toner is dropped and supplied into the developing device 14. The developing drum 14*a* and the toner supply motor 31 operate independently from each other. That is, the toner is not supplied by the toner supply motor 31 in cooperation with the operation of the developing drum 14*a*. The developing device 14 is an example of a developing unit that develops, with the toner, an electrostatic latent image formed on the photoconductive drum 11. The toner supply motor 31 is an example of a supplying unit that supplies the developer from the toner cartridge 30 to the developing device 14.

The toner residual amount detection sensor 37 that measures a toner residual amount is provided in the developing device 14. The toner residual amount detection sensor 37 measures a voltage on the inside of the developing device 14. The toner residual amount detection sensor 37 detects a residual amount of the toner according to the measured voltage. Details about the detection of the residual amount of the toner are explained below.

The toner cartridge 30 includes the storage medium 35. For example, the reading and writing unit 36 reads out control information from the storage medium 35. The storage medium 35 stores control information for controlling the electrifying charger 12 and the developing drum 14*a*. The control information for controlling the electrifying charger 12 is an electrifying bias indicating a voltage applied to the photoconductive drum 11 by the electrifying charger 12. The control information for controlling the developing drum 14*a* is a developing bias indicating a voltage applied to toner if the developing drum 14*a* develops an electrostatic latent image with the toner. Various parameters used in image formation are decided by a relation between the electrifying bias and the developing bias.

In general, the control information is information different for each of toner cartridges 30. Even if types of the toner cartridges 30 are the same, for example, the control information is sometimes different for each of lot numbers.

If the user replaces the toner cartridge 30, the user opens a cover (not illustrated) for storing the toner cartridge 30. Subsequently the user removes the toner cartridge 30 to be replaced, sets a new toner cartridge 30, and closes the cover.

If the cover is closed, the image forming apparatus 100 can acquire control information from the toner cartridge 30. The acquired control information is stored in the image forming apparatus 100.

The toner supply motor 31, the reading and writing unit 36, and the toner residual amount detection sensor 37 are controlled by the control unit 400.

Figures 3, 4, 5, 6:
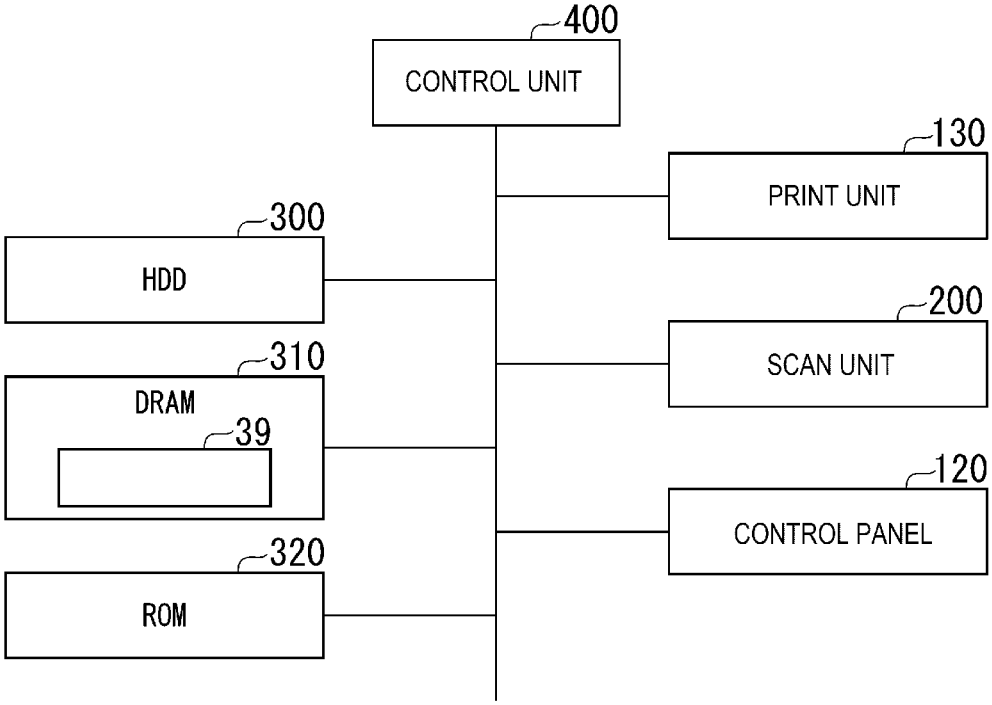
FIG. 3 is a diagram illustrating the configuration of a control system of the image forming apparatus.
FIG. 4 is a diagram illustrating a data structure of toner characteristic information.
FIG. 5 is a diagram illustrating a relation between a voltage on the inside of a developing device and a toner residual amount.
FIG. 6 is a diagram illustrating a supply start residual amount.

FIG. 3 is a diagram illustrating the configuration of a control system of the image forming apparatus 100.

The image forming apparatus 100 includes the print unit 130, the scan unit 200, the control panel 120, the control unit 400, an HDD (Hard Disk Drive) 300, a DRAM (Dynamic Random Access Memory) 310, and a ROM (Read Only Memory) 320. These units are connected via a system bus.

The ROM 320 stores various control programs necessary for the image forming apparatus 100 to operate. Programs for controlling an image forming operation and a control information switching operation are stored in the ROM 320. Execution of the programs is controlled by the control unit 400. The DRAM 310 is a buffer memory that temporarily stores data generated during the execution of the programs. A region 39 of the DRAM 310 is a region where control information acquired from the toner cartridge 30 is stored.

The control unit 400 is directly or indirectly connected to at least the toner residual amount detection sensor 37, the reading and writing unit 36, and the toner supply motor 31 illustrated in FIG. 2. The control unit 400 controls the operations of the units connected via the system bus and units related to toner residual amount management.

Toner control processing for performing control concerning toner is explained. First, details of control information are explained. FIG. 4 is a diagram illustrating a data structure of the control information. A1 to A3 illustrated in FIG. 4 indicate leading addresses where data are stored. The control information includes a serial number, an electrifying bias, and a developing bias. The serial number is identification information uniquely allocated to each of the toner cartridges 30. The electrifying bias and the developing bias are as explained above. The control unit 400 acquires the control information if the cover is closed.

Detection of a toner residual amount is explained. FIG. 5 is a diagram illustrating a relation between a voltage E on the inside of the developing device 14 and a toner residual amount. In FIG. 5, a correspondence relation between the voltage E (a unit is volt) and the residual amount (a unit is gram) is illustrated. The developing device 14 in this embodiment can store maximum 500 grams of a developer. 7% of the developer is toner. Accordingly, the developing device 14 can store maximum 35 grams of the toner.

The residual amount when the voltage E is lower than 4 is more than 3.5 grams. The residual amount when the voltage E is equal to or higher than 4 and lower than 4.2 is 3.5 grams. The residual amount when the voltage E is equal to or higher than 4.2 and lower than 4.4 is 3.4 grams. The residual amount when the voltage E is equal to or higher than 4.4 and lower than 4.6 is 3.3 grams. The residual amount when the voltage E is equal to or higher than 4.6 and lower than 4.8 is 3.2 grams. The residual amount when the voltage E is equal to or higher than 4.8 is 3.1 grams or less. As illustrated in FIG. 5, the residual amount decreases according to an increase in the voltage.

FIG. 6 is a diagram illustrating a supply start residual amount. The supply start residual amount is a reference for the control unit 400 to start supply of toner. If a detected toner residual amount is the supply start residual amount or less, the supply is started.

In this embodiment, as types of the reference for starting the supply, two types of references, that is, a first residual amount and a second residual amount are provided. The first residual amount is a reference used if the toner cartridge 30 is not replaced. The second residual amount is a reference used if the toner cartridge 30 is replaced. A plurality of second residual amounts are provided. Anyone residual amount among the provided plurality of residual amounts is used according to a similarity degree of control information of the toner before the replacement and control information of the toner after the replacement.

If the similarity degree of the control information is high, even if the toner before the replacement and the toner after the replacement are mixed, image quality is not significantly affected. On the other hand, if the similarity degree of the control information is low, the image quality is significantly affected if the toner before the replacement and the toner after the replacement are mixed. Therefore, in this embodiment, by providing the plurality of residual amounts in the second reference, it is possible to suppress deterioration in the image quality and supply the toner at appropriate timing.

As illustrated in FIG. 6, the first residual amount in this embodiment is 3.5 grams. The second residual amounts in this embodiment are 3.4 grams, 3.3 grams, and 3.2 grams. A reference with a larger residual amount is used as the similarity degree of the control information of the toner before replacement and the control information of the toner after the replacement is higher.

A method of determining a supply start residual amount to be used by the control unit 400 among the second residual amounts is explained. An electrifying bias indicated by the control information of the toner before the replacement is represented as A1 and a developing bias indicated by the control information is represented as B1. An electrifying bias indicated by the control information of the toner after the replacement is represented as A2 and a developing bias indicated by the control information is represented as B2. A value obtained by subtracting a minimum value from a maximum value in a range of values that the electrifying bias can take is represented as A. A value obtained by subtracting a minimum value from a maximum value in a range of values that the developing bias can take is represented as B.

The control unit 400 derives a determination value $D=|A1-A2|/A+|B1-B2|/B$. The determination value D is a value indicating the similarity degree of the control information. The determination value D is smaller as the similarity degree of the control information of the toner before the replacement and the control information of the toner after the replacement is higher. The determination value D is larger as the similarity degree of the control information of the toner before the replacement and the control information of the toner after the replacement is lower.

The control unit 400 determines, using the determination value D and constants P and Q (P<Q), which of the second residual amount is used. If the determination value D≤P, the control unit 400 determines the supply start residual amount as 3.4 grams. If P<the determination value D≤Q, the control unit 400 determines the supply start residual amount as 3.3 grams. If Q<the determination value D, the control unit 400 determines the supply start residual amount as 3.2 grams. If the determination value D is 0, the control unit 400 may start the supply if the residual amount decreases to 3.5 grams or less. The constants P and Q are decided as appropriate according to, for example, a nature of the toner.

Figure 7:
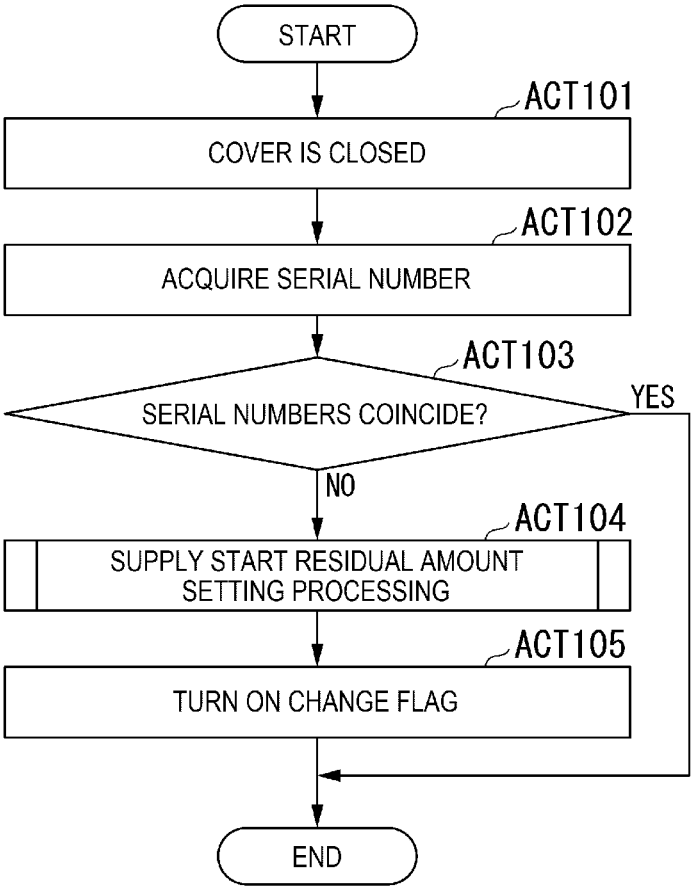
FIG. 7 is a flowchart illustrating a flow of cover closing time processing.

A flow of toner control processing is explained. First, processing performed if the cover is closed is explained. FIG. 7 is a flowchart illustrating a flow of cover closing time processing.

The control unit 400 detects that the cover is closed (ACT 101). The control unit 400 acquires a serial number from the toner cartridge 30 (ACT 102). The control unit 400 determines whether a serial number stored in the region 39 of the DRAM 310 and the acquired serial number coincide (ACT 103). If the serial numbers coincide (YES in ACT 103), the control unit 400 ends the processing.

If the serial numbers are different (NO in ACT 103), the control unit 400 performs supply start residual amount determination processing for determining a supply start residual amount (ACT 104). The control unit 400 turns on a change flag (ACT 105) and ends the processing. The change flag is a flag indicating whether the toner cartridge 30 is changed. The change flag is turned on if the toner cartridge 30 is changed and is turned off if the toner cartridge 30 is not changed.

As illustrated in ACT 103, the control unit 400 acquires, from the toner cartridge 30, a serial number for identifying the toner cartridge 30 and determines, using the acquired serial number, whether the toner cartridge 30 is replaced.

Figure 8:
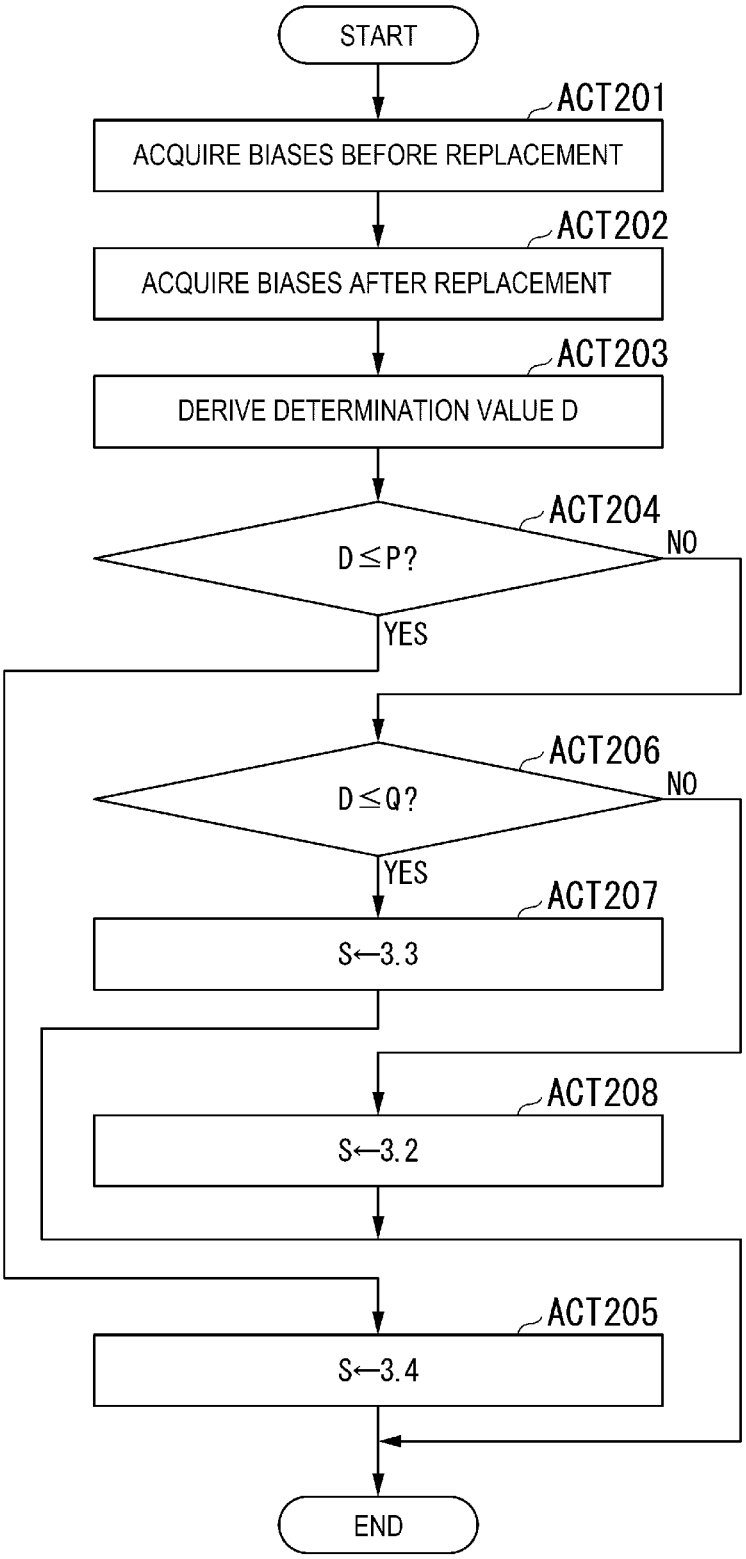
FIG. 8 is a flowchart illustrating a flow of supply start residual amount determination processing.

The supply start residual amount determination processing in ACT 104 is explained. FIG. 8 is a flowchart illustrating a flow of the supply start residual amount determination processing.

The control unit 400 acquires biases (an electrifying bias and a developing bias) before replacement stored in the region 39 (ACT 201). The control unit 400 acquires biases (an electrifying bias and a developing bias) after the replacement from the control information in the toner cartridge 30 (ACT 202). The control unit 400 derives the determination value D from the electrifying bias and the developing bias stored in the region 39 and the electrifying bias and the developing bias acquired from the toner cartridge 30 (ACT 203). A method of deriving the determination value D is as explained above.

The control unit 400 determines whether the determination value D≤P (ACT 204). P is the above-described constant P. If the determination value D≤P (YES in ACT 204), the control unit 400 determines the supply start residual amounts as 3.4 grams (ACT 205) and ends the processing. If not the determination value D≤P (NO in ACT 204), the control unit 400 determines whether the determination value D≤Q (ACT 206). Q is the above-described constant Q. If the determination value D≤Q (YES in ACT 206), the control unit 400 determines the supply start residual amount S as 3.3 grams (ACT 207) and ends the processing. If not the determination value D≤Q (NO in ACT 206), the control unit 400 determines the supply start residual amount S as 3.2 grams (ACT 208) and ends the processing.

Figure 9:
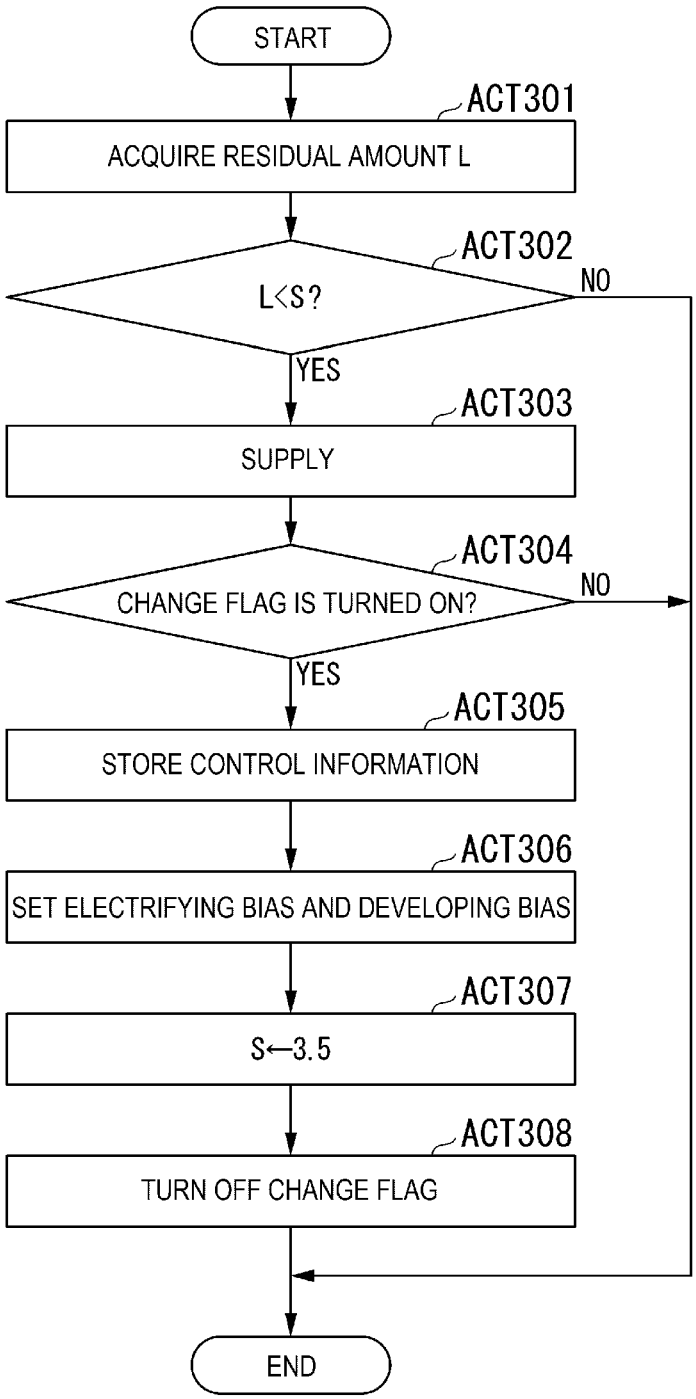
FIG. 9 is a flowchart illustrating a flow of supply start residual amount determination processing.

Residual amount acquisition time processing performed when a residual amount detected by the toner residual amount detection sensor 37 is acquired is explained. FIG. 9 is a flowchart illustrating a flow of the residual amount acquisition time processing.

The control unit 400 acquires a residual amount L detected by the toner residual amount detection sensor 37 (ACT 301). Timing when the control unit 400 acquires the residual amount L is, for example, periodic timing at every fixed time. The control unit 400 determines whether the residual amount L<the supply start residual amount S (ACT 302). If not the residual amount L<the supply start residual amount S (NO in ACT 302), the control unit 400 ends the processing.

If the residual amount L<the supply start residual amount S (YES in ACT 302), the control unit 400 drives the toner supply motor 31 to perform supply (ACT 303). After the supply, the control unit 400 determines whether the change flag is on (ACT 304). If the change flag is not on (NO in ACT 304), the control unit 400 ends the processing.

If the change flag is on (YES in ACT 304), the control unit 400 acquires control information from the toner cartridge 30 and stores the acquired control information in the region 39 of the DRAM 310. Consequently, the control information stored in the region 39 is updated to the control information of the toner after the replacement. The control unit 400 sets, as biases used in the following image formation, the electrifying bias and the developing bias indicated by the control information of the toner after the replacement (ACT 306). In ACT 306 and subsequent acts, the set electrifying bias and the set developing bias are used until an electrifying bias and a developing bias are set in ACT 306 again. The control unit 400 determines the supply start residual amount S as 3.5 grams (see FIG. 6) (ACT 307). The control unit 400 turns off the change flag (ACT 308) and ends the processing.

As illustrated in ACT 306, if the toner cartridge 30 is replaced, the control unit 400 controls the electrifying charger 12 and the developing drum 14*a* using the control information acquired from the toner cartridge 30 before the replacement until the toner in the toner cartridge 30 after the replacement is supplied to the developing device 14 by the toner supply motor 31.

As illustrated in ACT 306, if the toner cartridge 30 is replaced, the control unit 400 controls the electrifying charger 12 and the developing drum 14*a* using the control information acquired from the toner cartridge 30 after the replacement if the toner in the toner cartridge 30 after the replacement is supplied to the developing device 14 by the toner supply motor 31.

Since the control information of the toner before the replacement is used until the toner after the replacement is supplied in this way, image quality is not deteriorated. In related art, the control information of the toner after the replacement is used at the timing when the toner cartridge is replaced. On the other hand, in this embodiment, the control information of the toner after the replacement is used at the timing when the toner after the replacement is supplied. Therefore, compared with related art, it is possible to suppress deterioration in image quality.

The supply start residual amount determination processing illustrated in FIG. 9 is sometimes performed during image formation. If performing the supply in ACT 303 during the image formation, the control unit 400 suspends the image formation until ACT 303 to ACT 306 end.

In the embodiment explained above, the mass of the toner is used as the supply start residual amount. However, the supply start residual amount is not limited to the mass of the toner. For example, a percentage of the toner may be used as the supply start residual amount. Specifically, 10% of toner storable in the developing device 14 may be used as the supply start residual amount. By using the percentage, it is possible to use a program in common in apparatuses in which the mass of the toner storable in the developing device 14 is different. It is possible to reduce manhour and cost.

The three residual amounts are described as an example of the second residual amounts in FIG. 6. However, the second residual amounts may be one, two, or four or more residual amounts. 3.2 grams is described as an example of the minimum value of the second residual amounts. However, the minimum value of the second residual amounts is not limited to 3.2 grams and only has to be 0 gram or more.

The method of deriving the determination value D may be any deriving method if the determination value D changes in proportion to a similarity degree. For example, if A1, A2, B1, and B2 described above are used for explanation, (A1, B1) and (A2, B2) may be respectively regarded as points on a coordinate and an Euclidean distance may be set as the determination value D.

In the embodiment explained above, if the toner cartridge 30 is not replaced, the first residual amount (3.5 grams) is used as the supply start residual amount. However, the supply start residual amount is not limited to 3.5 grams. The supply start residual amount may be, for example, 3.8 grams or 3.6 grams. The toner may be supplied as appropriate by an amount corresponding to the residual amount.

The functions of the image forming apparatus in the embodiment explained above may be realized by a computer. In that case, the functions may be realized by recording a program for realizing the functions in a computer-readable recording medium, causing the computer system to read the program recorded in the recording medium, and executing the program. The "computer system" includes an OS and hardware such as peripheral devices. The "computer-readable recording medium" means a portable medium such as a flexible disk, a magneto-optical disk, a ROM, or a CD-ROM or a storage device such as a hard disk incorporated in the computer system. Further, the "computer-readable recording medium" may include a medium that dynamically retains the program for a short time like a communication wire in the case in which the program is transmitted via a network such as the Internet or a communication line such as a telephone line or a medium that retains the program for a fixed time like a volatile memory on the inside of a computer system functioning as a server or a client in that case. The program may be a program for realizing a part of the functions explained above or may be a program that can be realized by combining the functions explained above with a program already recorded in the computer system.

The several embodiments are explained above. However, the embodiments are presented as examples and are not intended to limit the scope of the invention. These embodiments can be implemented in other various forms. Various omissions, substitutions, and changes can be made without departing from the spirit of the invention. These embodiments and modifications of the embodiments are included in the scope and the gist of the invention and included in the inventions described in claims and the scope of equivalents of the inventions.

What is claimed is:

1. An image forming apparatus, comprising:

an image bearing device on which an electrostatic latent image is formed;

a developing component configured to develop, with a recording agent, the electrostatic latent image formed on the image bearing device;

a supplying component configured to supply the recording agent from a recording agent cartridge to the developing component;

a detector configured to detect a residual amount of the recording agent in the developing component; and a controller configured to control, if the recording agent cartridge is not replaced, the supplying component to supply the recording agent to the developing component if the residual amount detected by the detector decreases to a first residual amount or less and control, if the recording agent cartridge is replaced, the supplying component to supply the recording agent in the recording agent cartridge after the replacement to the developing component if the residual amount of the recording agent in the developing component before the replacement detected by the detector decreases to a second residual amount or less, the second residual amount being less than the first residual amount;

an application-to-image-bearing-device component configured to apply a voltage to a surface of the image bearing device; and an application-to-recording-agent component configured to apply a voltage to the recording agent if the developing component performs the development, wherein the controller acquires, from the recording agent cartridge, control information for controlling the application-to-image-bearing-device component and the application-to-recording-agent component and, if the recording agent cartridge is replaced, controls the application-to-image-bearing-device component and the application-to-recording-agent component using the control information acquired from the recording agent cartridge before the replacement until the recording agent in the recording agent cartridge after the replacement is supplied to the developing component by the supplying component.

2. The apparatus according to claim 1, wherein, if the recording agent cartridge is replaced, the controller controls the application-to-image-bearing-device component and the application-to-recording-agent component using the control information acquired from the recording agent cartridge after the replacement if the recording agent in the recording agent cartridge after the replacement is supplied to the developing component by the supplying component.

3. The apparatus according to claim 1, wherein the controller acquires, from the recording agent cartridge, identification information for identifying the recording agent cartridge and determines, using the acquired identification information, whether the recording agent cartridge is replaced.

4. The apparatus according to claim 1, wherein the detector detects the residual amount by measuring a voltage in the developing component.

5. The apparatus according to claim 1, wherein the image bearing device comprises a photoconductive drum.

6. The apparatus according to claim 1, wherein the supplying component comprises a toner cartridge and the recording agent comprises toner.

7. The apparatus according to claim 1, wherein the application-to-image-bearing-device component comprises an electrifying charger and the application-to-recording-agent component comprises a developing drum.

8. A control method for an image forming apparatus, comprising:

controlling a supplying component to supply a recording agent from a recording agent cartridge to a developing component configured to develop, with a recording agent, an electrostatic latent image formed on an image bearing device, if a residual amount of the recording agent in the developing component detected by the detector decreases to a first residual amount or less; and controlling, if the recording agent cartridge is replaced, the supplying component to supply the recording agent in the recording agent cartridge after the replacement to the developing component if the residual amount of the recording agent in the developing component before the replacement detected by the detector decreases to a second residual amount or less, the second residual amount being less than the first residual amount;

applying a voltage to a surface of the image bearing device using an application-to-image-bearing-device component;

applying a voltage to the recording agent if the developing component performs the development using an application-to-recording-agent component; and acquiring, from the recording agent cartridge, control information for controlling the application-to-image-bearing-device component and the application-to-recording-agent component and, if the recording agent cartridge is replaced, controlling the application-to-image-bearing-device component and the application-to-recording-agent component using the control information acquired from the recording agent cartridge before the replacement until the recording agent in the recording agent cartridge after the replacement is supplied to the developing component by the supplying component.

9. The control method according to claim 8, further comprising:

if the recording agent cartridge is replaced, controlling the application-to-image-bearing-device component and the application-to-recording-agent component using the control information acquired from the recording agent cartridge after the replacement if the recording agent in the recording agent cartridge after the replacement is supplied to the developing component by the supplying component.

10. The control method according to claim 8, further comprising:

acquiring, from the recording agent cartridge, identification information for identifying the recording agent cartridge and determines, using the acquired identification information, whether the recording agent cartridge is replaced.

11. The control method according to claim 8, further comprising:

detecting the residual amount by measuring a voltage in the developing component.

12. An image forming apparatus, comprising:

an image bearing device on which an electrostatic latent image is formed;

a developing component configured to develop, with a toner, the electrostatic latent image formed on the image bearing device;

a supplying component configured to supply the toner from a recording agent cartridge to the developing component;

a detector configured to detect a residual amount of the toner in the developing component;

a controller configured to control, if the recording agent cartridge is not replaced, the supplying component to supply the toner to the developing component if the residual amount detected by the detector decreases to a first residual amount or less and control, if the recording agent cartridge is replaced, the supplying component to supply the toner in the recording agent cartridge after the replacement to the developing component if the residual amount of the toner in the developing component before the replacement detected by the detector decreases to a second residual amount or less, the second residual amount being less than the first residual amount;

an application-to-image-bearing-device component configured to apply a voltage to a surface of the image bearing device; and an application-to-toner component configured to apply a voltage to the toner if the developing component performs the development, wherein the controller acquires, from the recording agent cartridge, control information for controlling the application-to-image-bearing-device component and the application-to-toner component and, if the recording agent cartridge is replaced, controls the application-to-image-bearing-device component and the application-to-toner component using the control information acquired from the recording agent cartridge before the replacement until the toner in the recording agent cartridge after the replacement is supplied to the developing component by the supplying component.

13. The apparatus according to claim 12, wherein, if the recording agent cartridge is replaced, the controller controls the application-to-image-bearing-device component and the application-to-toner component using the control information acquired from the recording agent cartridge after the replacement if the toner in the recording agent cartridge after the replacement is supplied to the developing component by the supplying component.

14. The apparatus according to claim 12, wherein the controller acquires, from the recording agent cartridge, identification information for identifying the recording agent cartridge and determines, using the acquired identification information, whether the recording agent cartridge is replaced.

15. The apparatus according to claim 12, wherein the detector detects the residual amount by measuring a voltage in the developing component.

16. The apparatus according to claim 12, wherein the image bearing device comprises a photoconductive drum.

17. The apparatus according to claim 12, wherein the application-to-image-bearing-device component comprises an electrifying charger and the application-to-toner component comprises a developing drum.

* * * * *